United States Patent [19]

Hendon

[11] Patent Number: 4,722,530

[45] Date of Patent: Feb. 2, 1988

[54] GAMING TABLE

[76] Inventor: William M. Hendon, 5104 Bob Dr., Fort Worth, Tex. 76118

[21] Appl. No.: 894,962

[22] Filed: Aug. 8, 1986

[51] Int. Cl.[4] ..... A63F 9/00

[52] U.S. Cl. ..... 273/309; 108/13; 108/62

[58] Field of Search ..... 273/284, 309, 5 R, 5 B, 273/5 C; 108/13, 27, 62

[56] References Cited

U.S. PATENT DOCUMENTS

| | | | |
|---|---|---|---|
| 747,097 | 12/1903 | Spalt | 108/13 UX |
| 1,353,728 | 9/1920 | Dence | 273/309 X |
| 1,991,217 | 2/1935 | Hyams | 108/62 |
| 3,227,105 | 1/1966 | Reisdorff | 108/13 |
| 3,743,287 | 7/1973 | Liermann | 273/5 R |

FOREIGN PATENT DOCUMENTS

| | | | |
|---|---|---|---|
| 1239072 | 9/1961 | Fed. Rep. of Germany | 273/284 |
| 2327929 | 12/1974 | Fed. Rep. of Germany | 273/284 |
| 174594 | 4/1935 | Switzerland | 108/13 |

*Primary Examiner*—Anton O. Oechsle
*Attorney, Agent, or Firm*—James E. Bradley

[57] ABSTRACT

A table having a cabinet with a rectangular opening in the upper surface. A three sided, rotatable frame is mounted on a shaft within the cabinet, so that a selected one of the sides is parallel to the upper surface of the cabinet. A rectangular table surface is releasably attached to each of the sides of the frame. The table surfaces are moved from the frame to the opening in the upper surface of the cabinet by a pair of plungers. The plungers are moved up and down by cables, which are drawn up and let out by an electric motor.

15 Claims, 5 Drawing Figures

GAMING TABLE

BACKGROUND OF THE INVENTION

1. Field of the Invention:

This invention relates in general to furniture. In particular, the invention relates to gaming tables for the playing of various card and dice games.

2. Description of the Prior Art:

Many games, such as some card or dice games, require a table surface having certain markings. If a single table is to be used for different games, at different times, there must be some way to change the table surface or the markings on the table surface.

U.S. Pat. No. 1,928,790 (Luhn), issued Oct. 3, 1933, shows a game table in which a plurality of game designs are printed on a long roll of flexible material. Rollers can be rotated to change from one game design to another. The table has a rectangular central opening adapted to receive a vertically movable board. An upward movement of the board serves to press the playing surface against the opening in the table surface and provides firm support for the playing surface during the play of the game.

U.S. Pat. No. 1,353,728 (Dence), issued Sept. 21, 1920, shows a table equipped with a rotatable or reversible surface, the faces of which contain different designs. The table surface also has retractable side rails which rotate or slide out of the way so that the table surface can be rotated or reversed.

SUMMARY OF THE INVENTION

The gaming table of the invention provides for a quick, easy way to change the markings on the table. The table has a cabinet with a rectangular opening in the upper surface of the cabinet. A rotatable frame, having at least two sides, is mounted on a shaft within the cabinet. The invention also includes means for rotating the frame about the shaft, to place a selected one of the sides in a position parallel to the upper surface of the cabinet.

The table has at least two table surfaces, each table surface being releasably attached to one of the sides of the frame. The uppermost table surface, which is attached to the side of the frame which is parallel to the upper surface of the cabinet, can be released from the frame and raised to the opening in the surface of the cabinet.

When the table surface is to be changed, the table surface is lowered back down to the frame. The table surface is raised and lowered by a pair of plungers, which are raised and lowered by a pair of cables attached to an electric motor.

The above, as well as additional objects, features, and advantages of the invention, will become apparent in the following detailed description.

DESCRIPTION OF THE PREFERRED EMBODIMENT

Figure 1:
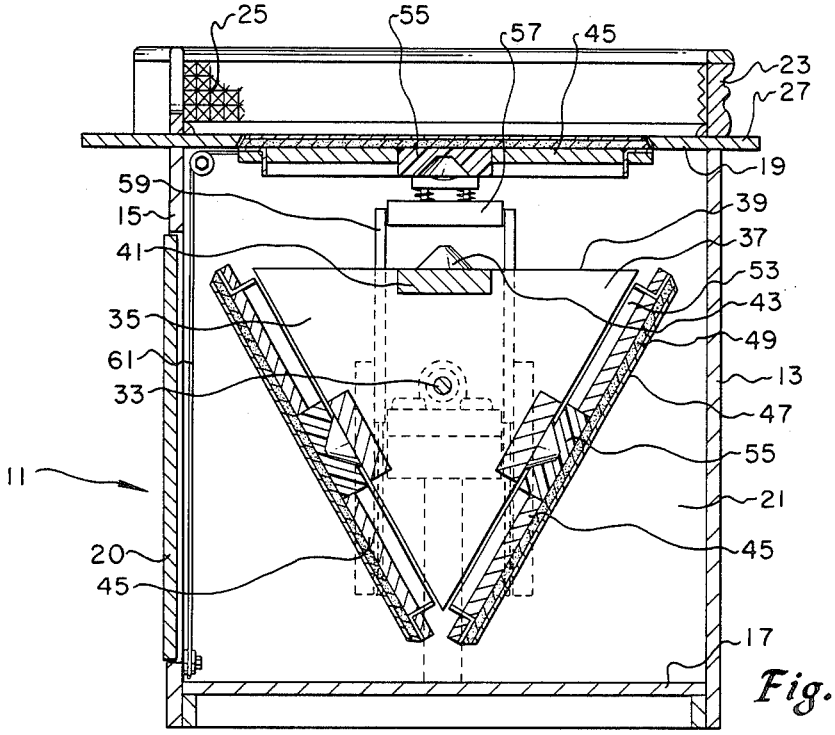
FIG. 1 is a sectional side view of the invention with one of the table surfaces in the upper position.
Figure 2:
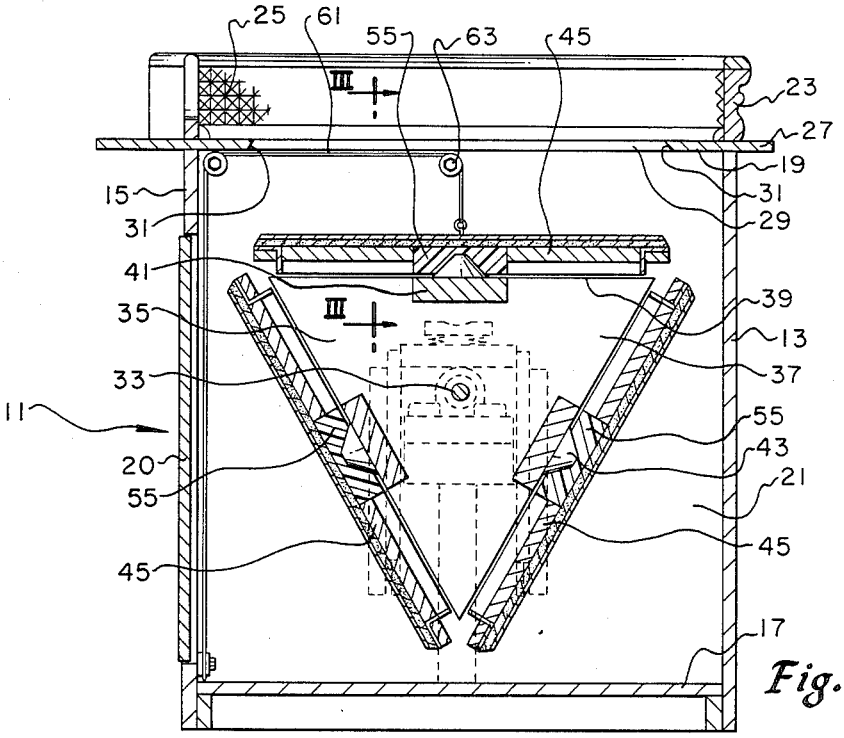
FIG. 2 is a sectional side view of the invention with all of the table surfaces attached to the frame.

As shown in FIGS. 1 and 2, the gaming table of the invention has a cabinet 11. The cabinet 11 has a front 13, a back 15, a floor 17, and an upper surface 19. The back 15 of the cabinet 11 has a hinged door 20 for giving access to the interior of the cabinet 11. The cabinet 11 also has an end panel 21 on each end. A vertical rail 23 which extends around the upper surface 19 of the cabinet 11. This rail 23 may have rubber pyramids 25 to provide a resilient surface for playing dice games.

The upper surface 19 may also include a shelf 27 for supporting drinks and other items. The upper surface 19 of the cabinet 11 has a rectangular opening 29. The edges 31 of the upper surface 19, around the opening 29, are angled downward and away from the center of the opening 29.

A shaft 33 is connected between the two end panels 21. A three-sided frame 35 is mounted on the shaft 33. The frame 33 has a triangular end piece 37 on each end. The three sides 39 of the frame 33 are formed by three lateral supports 41, which extend from one end piece 37 to the other. Each support 41 has a pair of cones 43, one cone 43 near each end of the support 41.

The frame 35 is rotatable about the shaft 33, to place a selected one of the sides 39 in a position parallel to the upper surface 19 of the cabinet 11. As the frame 35 rotates, the three sides 39 of the frame 35 rotate about a path which is located entirely below the upper surface 19 of the cabinet 11.

The gaming table of the invention also has three table surfaces 45. Each table surface 45 is constructed of a felt cover 47, over a thin sheet 49 of plywood, glued to a sheet 51 of foam insulation, and supported by a framework 53 of independently mounted angled steel members. The flexible construction of the table surfaces 45 helps to reduce warping problems. The felt cover 47 on each table surface 45 has markings for a different game, such as blackjack, craps, or baccarat. Each table surface 45 also has a pair of plastic female cones 55, which are adapted to mate with the cones 43 on the supports 41 of the frame 35.

A pair of plungers 57 are mounted on rails 59 near each end panel 21. Each plunger 57 is attached to a cable 61, which extends upward to a pulley 63.

Figure 5:
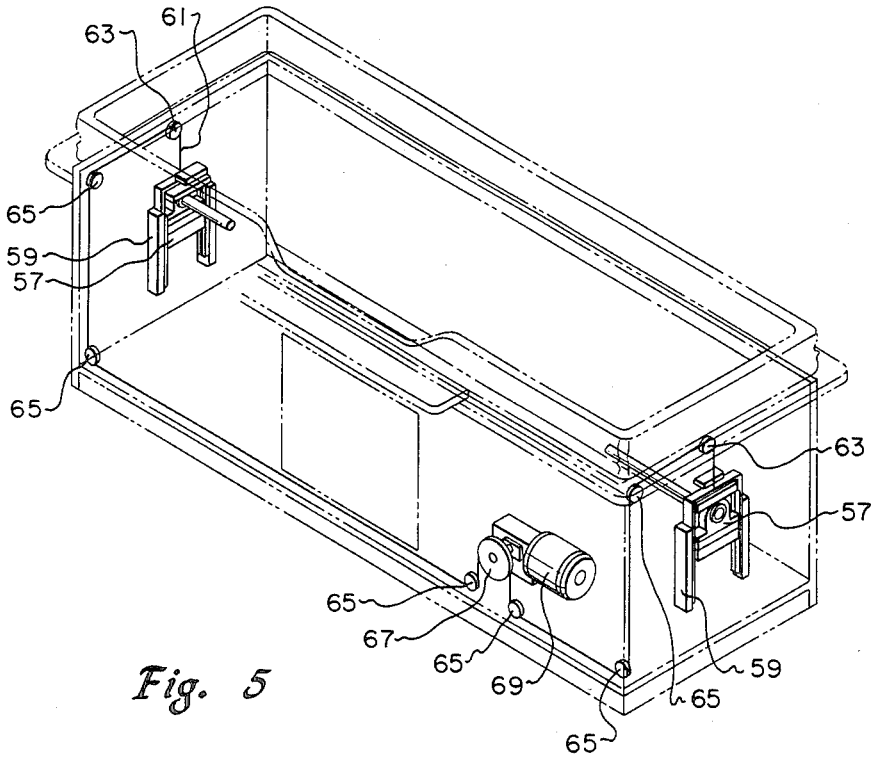
FIG. 5 is a sectional perspective view of the cabinet and the means for moving the table surfaces.

As shown in FIG. 5, the two cables 61 extend over the pulleys 63, and then over a series of additional pulleys 65 to a large pulley 67 on an electric motor 69. As the electric motor 69 turns the large pulley 67, the cables 61 are drawn in or let out, moving the plungers 57 up or down. The electric motor 69 is thus a means for drawing up and letting out the cables 61, and the cables 61 are a means for moving the plungers 57 vertically.

Figure 3:
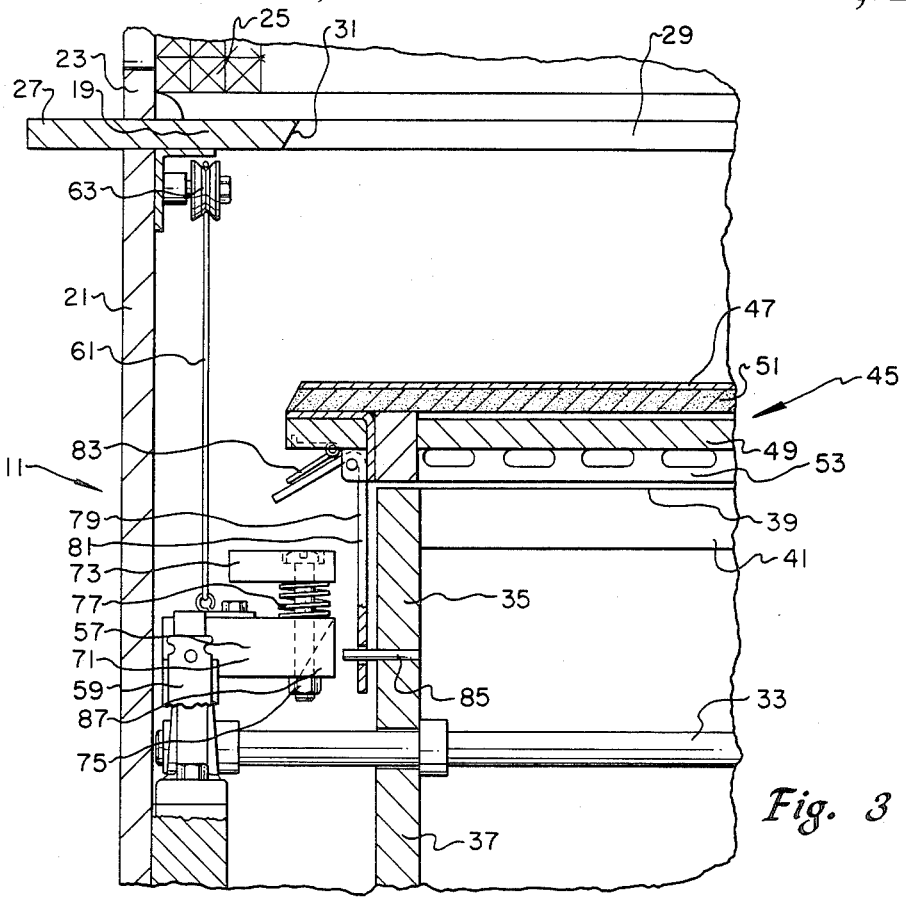
FIG. 3 is a sectional close up view of the invention, as seen along lines III—III in FIG. 2.
Figure 4:
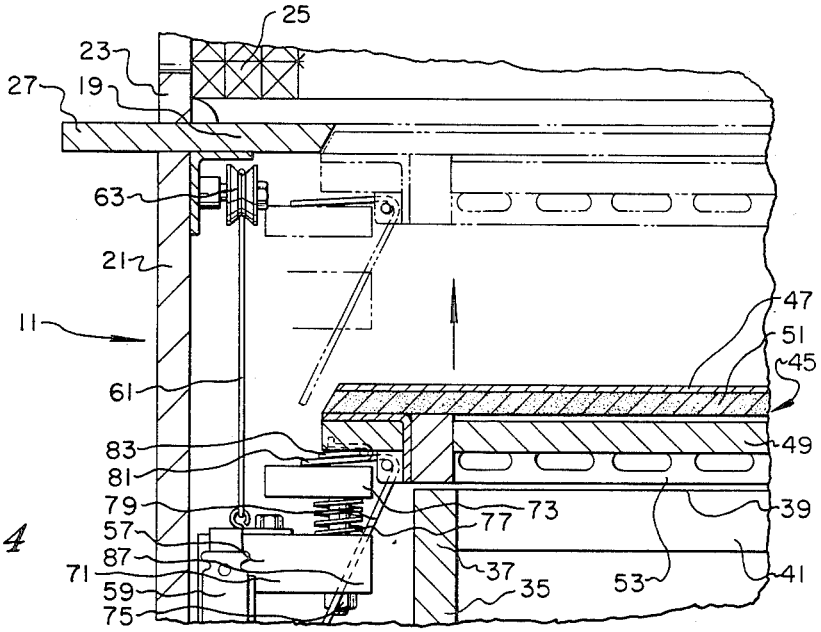
FIG. 4 is a sectional close up view of the invention, similar to the view of FIG. 3, but showing one of the table surfaces being picked up from the frame.

FIGS. 3 and 4 illustrate the latching mechanism for releasably attaching the table surfaces 45 to the sides 39 of the frame 35. The frame 35 has been rotated on the shaft 33 to place a selected one of the sides 39 in a position parallel to the upper surface 19 of the cabinet 11. As the frame 35 is rotated, the table surfaces 45 are rotated about a path located entirely below the upper surface 19 of the cabinet 11, to position a selected one of the table surfaces 45 below and parallel to the upper surface 19 of the cabinet 11.

The plunger 57 has a main block 71 and a contact block 73, connected together by a nut and bolt assembly 75. A spring 77 holds the contact block 73 up off of the main block 71.

Each table surface 45 is connected to the frame 35 by a latch mechanism 79. Each latch mechanism 79 has a latch 81, which is a piece of angled metal. The latch 81 is biased by a spring 83 to a position in which the latch 81 engages a pin 85 on the frame 35. The latch 81 and the pin 85 are a latch means for releasably attaching each table surface 45 to one of the sides 39 of the frame 35.

The table surfaces 45 are changed in the following manner. The cabinet 11 begins with one of the table surfaces 45 in the upper position, as shown in FIG. 1. The electric motor 69 is turned on by a foot pedal or a push button. The cables 61 are let out, and the weight of the table surface 45 causes the table surface 45 to lower down to the frame 35.

As the table surface 45 reaches the frame 35, the plunger 57 no longer contacts the latch 81. The spring 83 rotates the latch 81 until the latch 81 engages the pin 85 on the frame 35. The table surface 45 is then connected to the frame 35.

The frame 35 can then be rotated about the shaft 33 until the desired table surface 45 is in the top position. The electric motor 69 is then turned on again, and the cables 61 pull the plungers 57 upward.

As the cables 61 raise the plungers 57, the contact block 73 contacts the latch 81. The contact block 73 overcomes the spring 83 and rotates the latch 81. The latch 81 disengages from the pin 85 and enters a recess 87 in the main block 71. The table surface 45 is then raised off of the frame 35 and moved upward to and flush with the opening 29 in the upper surface 19 of the cabinet 11, as shown in shadow in FIG. 4.

The gaming table of the invention has several advantages over the prior art. The table surfaces can be quickly and easily changed. The table surfaces are recessed into the cabinet during the rotation of the frame, so the table surfaces are clear of the cabinet. Further, the table surfaces are designed in a manner that greatly reduces warping. In addition, when one of the table surfaces 45 is in the upper position, the frame 35 is bottom heavy. Therefore, the weight of the frame 35 will keep the frame 35 aligned, and there is no need to lock the frame 35 against rotation.

The invention has been shown in only one of its forms. It should be apparent to those skilled in the art that it is not so limited, but is susceptible to various changes and modifications without departing from the spirit thereof.

I claim:

1. A table, comprising:
a cabinet, having an upper surface with an opening;
a plurality of table surfaces, located in the cabinet;
means for rotating the table surfaces about a path located entirely below the upper surface of the cabinet, to position a selected one of the table surfaces below and parallel to the upper surface of the cabinet;
means for moving the selected table surface upward to and flush with the opening in the upper surface of the cabinet.

2. A table, as recited in claim 1, wherein the means for moving the selected table surface further comprises:
a pair of plungers, each plunger movable to contact one end of the selected table surface; and
means for moving the plungers vertically.

3. A table, as recited in claim 2, wherein the means for moving the plungers further comprises:
a pair of cables, each cable being connected to one of the plungers; and
means for drawing up and letting out the cables.

4. A table, as recited in claim 3, wherein the means for drawing up and letting out the cables further comprises an electric motor.

5. A table, comprising:
a cabinet, having an upper surface with an opening;
a frame, mounted within the cabinet, the frame having at least three sides, and being rotatable, to place a selected one of the sides in a position parallel to the upper surface of the cabinet;
a plurality of table surfaces, each table surface being releasably attached to one of the sides of the frame; and
means for moving the table surface which is attached to the selected side of the frame from the frame to the opening in the upper surface of the cabinet and back to the frame.

6. A table, as recited in claim 5, wherein the means for moving the table surface further comprises:
a pair of plungers, each plunger being movable to contact one end of the table surface; and
means for moving the plungers vertically.

7. A table, as recited in claim 6, wherein the means for moving the plungers further comprises:
a pair of cables, each cable being connected to one of the plungers; and
means for drawing up and letting out the cables.

8. A table, as recited in claim 7, wherein the means for drawing up and letting out the cables further comprises an electric motor.

9. A table, comprising:
a cabinet, having an upper surface with an opening;
a frame, mounted within the cabinet, the frame having three sides, and being rotatable, to place a selected one of the sides in a position parallel to the upper surface of the cabinet;
three table surfaces;
latch means for releasably attaching each table surface to one of the sides of the frame; and
means for moving the table surface which is attached to the selected side of the frame from the frame to the opening in the upper surface of the cabinet and back to the frame.

10. A table, as recited in claim 9, wherein:
the latch means comprises a latch on the table surface and a pin on the frame; and
the means for moving the table surface further comprises a pair of plungers, each plunger being movable to contact one end of the table surface which is attached to the selected side of the frame, and means for moving the plungers vertically.

11. A table, as recited in claim 10, wherein the means for moving the plungers further comprises:
a pair of cables, each cable being connected to one of the plungers; and
means for drawing up and letting out the cables.

12. A table, as recited in claim 11, wherein the means for drawing up and letting out the cables further comprises an electric motor.

13. A table, as recited in claim 12, wherein the plungers hold the table surface which is attached to the selected side of the frame flush with the upper surface of the cabinet.

14. A method of providing a game table with at least three playing surfaces, comprising the steps:

providing a cabinet with a rectangular opening in its upper surface;

mounting a rotatable frame on a shaft fixed within the cabinet;

providing the frame with three sides, each side being rotatable about the shaft, to place a selected one of the sides in a position parallel to the upper surface of the cabinet;

releasably mounting a rectangular table surface on each of the sides of the frame;

rotating the frame to place a selected one of the table surfaces below and parallel to the upper surface of the cabinet;

releasing the selected table surface from the frame; and raising the selected table surface to the opening and flush with the upper surface of the cabinet.

15. A method of providing a game table with at least three playing surfaces, as recited in claim 14, further comprising the steps:

lowering the selected table surface to the selected side of the frame;

latching the selected table surface to the frame;

rotating the frame to place a newly selected one of the table surfaces below and parallel to the upper surface of the cabinet;

releasing the newly selected table surface from the frame; and raising the newly selected table surface to the opening and flush with the upper surface of the cabinet.

* * * * *